US007111758B1

(12) United States Patent
Monks

(10) Patent No.: US 7,111,758 B1
(45) Date of Patent: Sep. 26, 2006

(54) TOOTHPASTE DISPENSING APPARATUS

(76) Inventor: Harold R. Monks, 6605 NE. 166th Ave., Vancouver, WA (US) 98682

( * ) Notice: Subject to any disclaimer, the term of this patent is extended or adjusted under 35 U.S.C. 154(b) by 0 days.

(21) Appl. No.: 10/899,581

(22) Filed: Jul. 27, 2004

(51) Int. Cl.
*B65D 35/28* (2006.01)

(52) U.S. Cl. ..... 222/102

(58) Field of Classification Search ..... 222/100.8–402, 222/93

See application file for complete search history.

(56) References Cited

U.S. PATENT DOCUMENTS 2,099,906 A * 11/1937 Reese et al. ..... 211/65
3,252,624 A * 5/1966 Watson, Jr. ..... 222/96
3,860,147 A 1/1975 Vessio et al.
4,010,873 A 3/1977 Mardirossian
4,258,864 A 3/1981 Karamanolis et al.
4,337,879 A * 7/1982 Park ..... 222/102
5,323,932 A 6/1994 Bauman
5,441,172 A 8/1995 Yu
5,447,255 A 9/1995 Smedley
D420,843 S 2/2000 Cardillo
6,364,165 B1 4/2002 Sampson et al.
6,401,985 B1 * 6/2002 DeMars ..... 222/209

* cited by examiner

*Primary Examiner*—Philippe Derakshani

(57) ABSTRACT

A toothpaste dispensing apparatus includes a base. A housing is attached to and extends upwardly from the base. The housing includes a peripheral wall that has an upper edge defining an opening. A toothpaste tube squeezing assembly is mounted within the housing and is adapted for selectively ejecting toothpaste out of a tube of toothpaste. A cover is hingedly attached to the upper edge of the housing. A flange is attached to and extends outwardly away from the cover. The cover has a dispensing conduit therein. The dispending conduit includes a receiving opening extending upwardly into the cover and an ejecting opening extending downwardly from the flange. The tube may be fluidly coupled to the receiving opening when the cover is placed in a closed position such that toothpaste flows into the receiving opening and outwardly through the ejecting opening when the toothpaste is ejected out of the tube.

8 Claims, 5 Drawing Sheets

TOOTHPASTE DISPENSING APPARATUS

BACKGROUND OF THE INVENTION

1. Field of the Invention

The present invention relates to toothpaste dispensing devices and more particularly pertains to a new toothpaste dispensing device for holding a tube of toothpaste and ejecting toothpaste therefrom.

2. Description of the Prior Art

The use of toothpaste dispensing devices is known in the prior art. U.S. Pat. No. 5,441,172 describes a device for coiling a collapsible tube of toothpaste so that the toothpaste therein is extracted as the tube is coiled. Another type of toothpaste dispensing device is U.S. Pat. No. 6,364,165 which includes a pair of spaced panels that are slid downward along a tube of toothpaste to force the toothpaste downward and outward of a housing into which the tube is positioned. Yet another device is U.S. Pat. No. 3,860,147 that includes a threaded saddle that is moved along the tube for again forcing the toothpaste downward and outward of the tube.

While these devices fulfill their respective, particular objectives and requirements, the need remains for a device that includes a housing that directs extracted toothpaste outward of a tube of toothpaste and outwardly away from the housing. The housing should also include toothbrush-storing capacity.

SUMMARY OF THE INVENTION

The present invention meets the needs presented above by generally comprising a base that has a top side, a bottom side and a peripheral edge. A housing is attached to and extends upwardly from the base. The housing includes a peripheral wall that has an upper edge. The upper edge defines an opening extending into the housing. A toothpaste tube squeezing assembly is mounted within the housing and is adapted for selectively ejecting toothpaste out of a tube of toothpaste. A cover is hingedly attached to the upper edge of the housing for selectively closing the opening in the housing. A flange is attached to and extends outwardly away from the cover. The cover has a dispensing conduit therein. The dispending conduit includes a receiving opening extending upwardly into the cover and an ejecting opening extending downwardly from the flange. The tube may be fluidly coupled to the receiving opening when the cover is placed in a closed position such that toothpaste flows into the receiving opening and outwardly through the ejecting opening when the toothpaste is ejected out of the tube of toothpaste.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
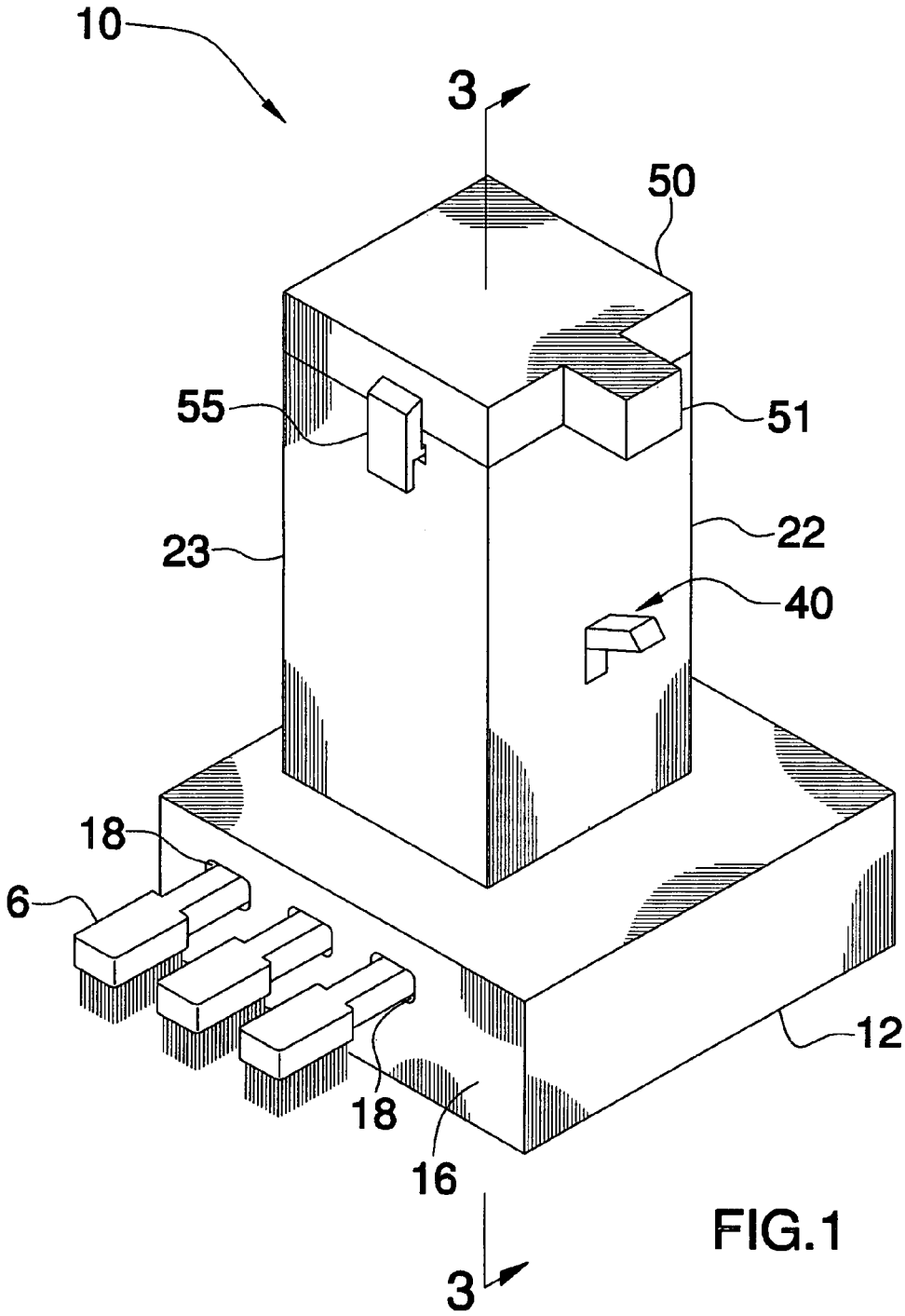
FIG. 1 is a front perspective view of a toothpaste dispensing apparatus according to the present invention.
Figure 2:
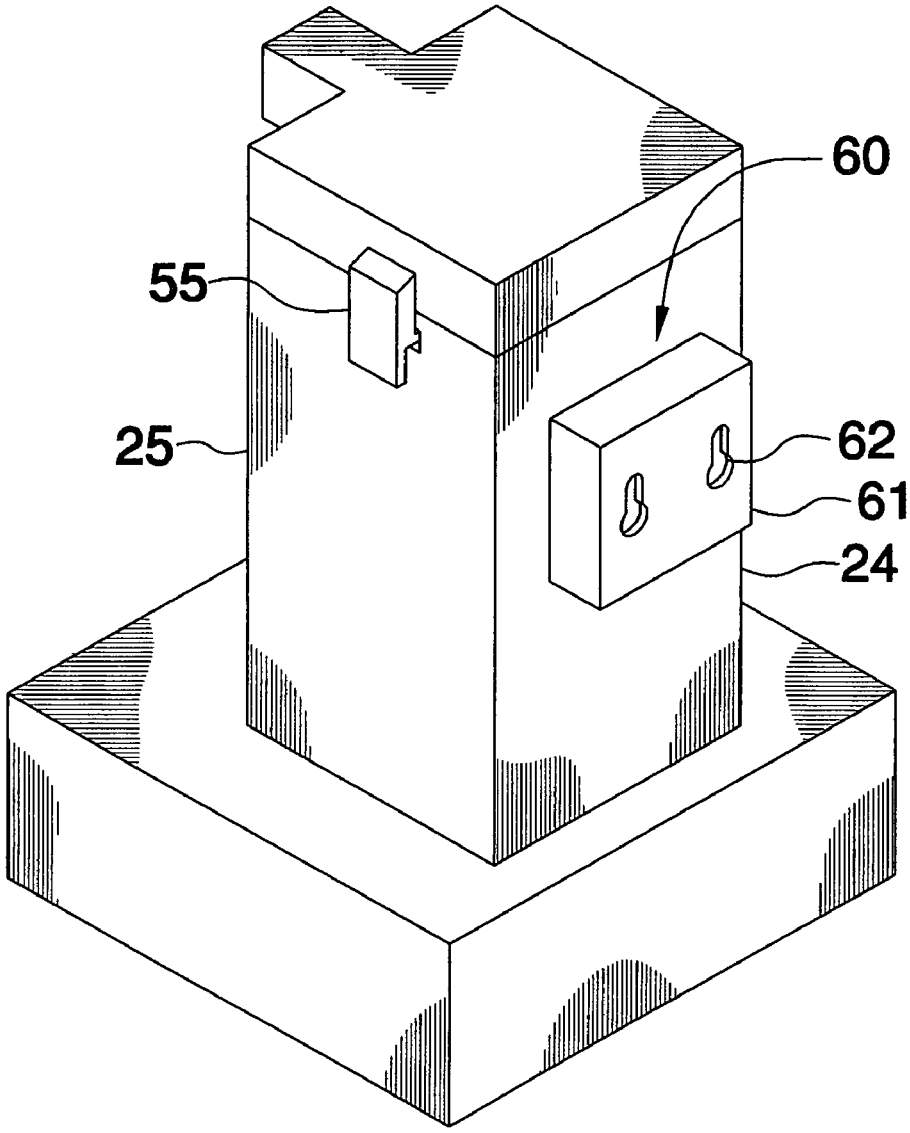
FIG. 2 is a back perspective view of the present invention.
Figure 3:
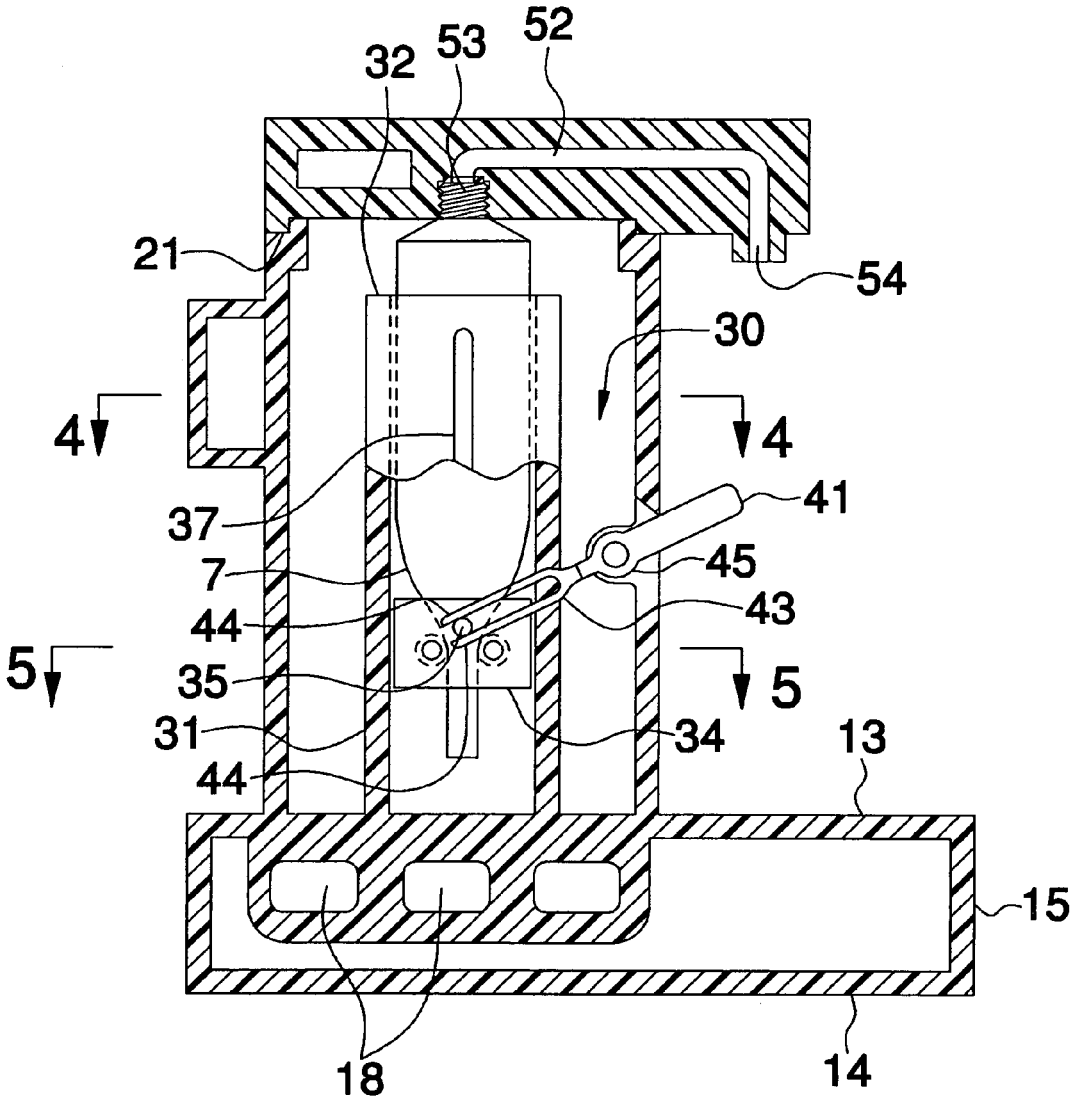
FIG. 3 is a cross-sectional view taken along line 3—3 of FIG. 1 of the present invention.
Figure 4:
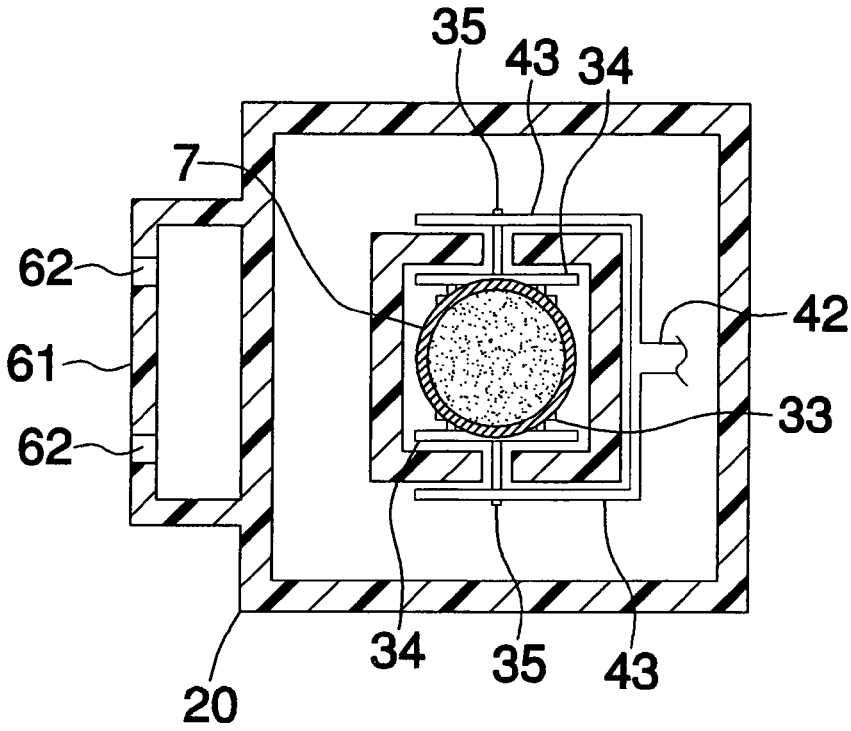
FIG. 4 is a cross-sectional view taken along line 4—4 of FIG. 3 of the present invention.
Figure 5:
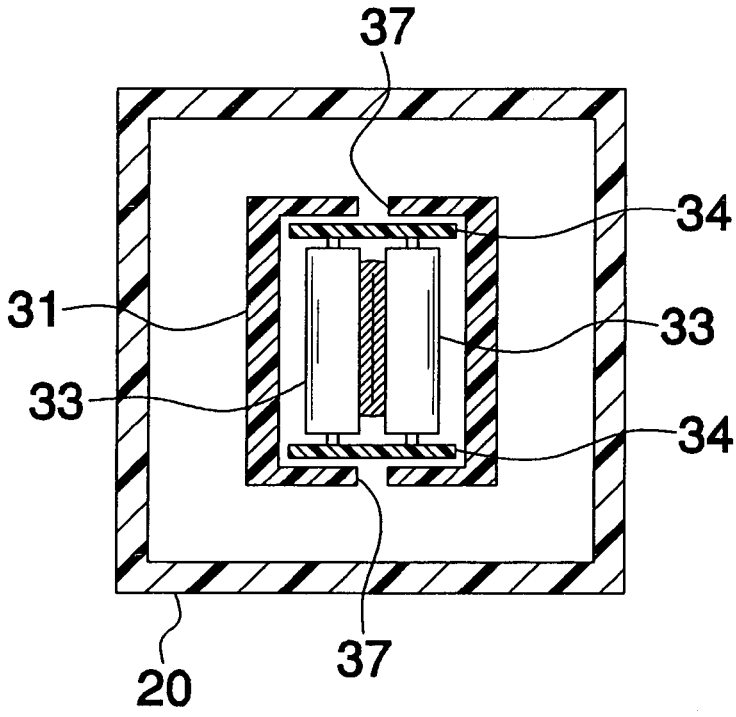
FIG. 5 is a cross-sectional view taken along line 5—5 of FIG. 3 of the present invention.
Figure 6:
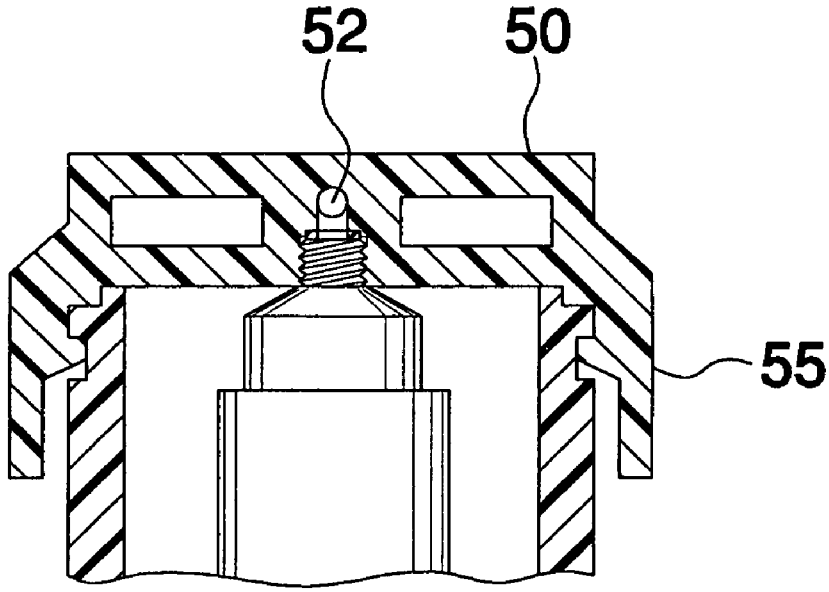
FIG. 6 is a cross-sectional view of the cover of the present invention.

With reference now to the drawings, and in particular to FIGS. 1 through 6 thereof, a new toothpaste dispensing device embodying the principles and concepts of the present invention and generally designated by the reference numeral 10 will be described.

As best illustrated in FIGS. 1 through 6, the toothpaste dispensing apparatus 10 generally comprises a base 12 that has a top side 13, a bottom side 14 and a peripheral edge 15. The top side 13 has a rectangular shape such that the peripheral edge 15 includes four side edges. A first of the side edge 16 has a plurality of wells 18 extending therein. Each of the wells 18 is adapted for selectively receiving a toothbrush handle. The plurality of wells 18 preferably includes at least three wells 18.

A housing 20 is attached to and extends upwardly from the base 12. The housing 20 includes a peripheral wall that has an upper edge 21. The upper edge 21 defines an opening extending into the housing. The peripheral wall 21 includes a first wall 22, a second wall 23, a third wall 24 and a fourth wall 25.

A toothpaste tube squeezing assembly 30 is mounted within the housing 20 and is adapted for selectively ejecting toothpaste out of a tube 7 of toothpaste. The squeezing assembly 30 includes a sleeve 31 that is mounted within the housing 20. The sleeve 31 has an open upper end 32. A pair of cylinders 33 is mounted in sleeve 31 and each is selectively movable vertically in the sleeve 31. The cylinders 33 are horizontally co-planar with each other and has rotational axis orientated parallel to each other. The cylinders 33 are rotationally attached to plates 34 positioned at either ends of the cylinders 33. The sleeve 31 is shown in broken cross-section to show the plate 34. Rods 35 are attached to each of the plates 34. The rods 35 extend through vertical slots 37 positioned in opposite sides of the sleeve 31. The tube 7 of toothpaste may be removably positioned within the sleeve 31 and between the cylinders 33. The pressure on the toothpaste tube 7 by the cylinders 33 causes the toothpaste within the tube 7 to be extracted as the cylinders 33 are selectively moved upwardly within the sleeve 31. An actuator 40 extends through the peripheral wall of the housing 20 and is coupled to the cylinders 33. The actuator 40 is adapted for selectively moving the cylinders 33 upwardly or downwardly within the sleeve 31. The actuator 40 includes an elongated member that has a first end 41 extending outwardly away from the housing 20 and a second end 42 attached to the cylinders. A central portion 45 of the elongated member is pivotally coupled to the housing 20. The second end 42 includes a forked member with a pair of arms 43. Each of the arms 43 includes a pair of tongs 44. Each of the rods 35 is positioned between one of the pair of tongs 44.

A cover 50 is hingedly attached to the upper edge 21 of the housing 20 for selectively closing the opening in the housing 50. A flange 51 is attached to and extends outwardly away from the cover 50. The cover 50 has a dispensing conduit 52 therein. The dispending conduit 52 includes a receiving opening 53 extending upwardly into the cover 50 that is generally aligned with the sleeve 31. The dispensing conduit 52 includes an ejecting opening 54 extending downwardly from the flange 51. The tube 7 may be fluidly coupled to the receiving opening 53 when the cover 50 is placed in a closed position so that toothpaste flows into the receiving opening 53 and outwardly through the ejecting opening 54 when the cylinders 33 are moved upwardly. The receiving opening 53 may be threaded for engaging a threaded neck of the tube 7. A latching assembly 55 is mounted on the cover 50 and is adapted for selectively locking the cover 50 in the closed position.

A mounting bracket 60 is attached to the housing 20. The mounting bracket 60 is positioned generally opposite with respect to the actuator 40. The mounting bracket 60 includes a plate 61 having one or more fastener receiving apertures 62 extending therethrough. A surface of the plate 61 is generally co-planar with the peripheral edge 15 of the base 12.

In use, the tube 7 of toothpaste is fluidly coupled with the receiving opening 53 and the tube 7 placed in the sleeve 31 so that its bottom end positioned between the cylinders 33. The housing 20 is mounted to a vertical surface. The cover 50 is closed and locked in position. The first end 41 of the actuator 40 is depressed which lifts the cylinders 33 and forces the toothpaste out of the tube 7 and into the dispensing conduit 52. The toothpaste comes out of the ejecting opening 54 and is then spread on the head of a toothbrush 6. When not in use, the toothbrushes 6 are stored in a horizontal position in the wells 18 of the base 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste dispensing assembly comprising:

a base having a top side, a bottom side and a peripheral edge;

a housing being attached to and extending upwardly from said base, said housing including a peripheral wall having an upper edge, said upper edge defining an opening extending into said housing;

a toothpaste tube squeezing assembly being mounted within said housing and being adapted for selectively ejecting toothpaste out of a tube of toothpaste, said squeezing assembly including;

a sleeve being fixedly mounted within said housing, said sleeve having an open upper end;

a pair of cylinders being mounted in sleeve and being selectively movable vertically in said sleeve, said cylinders being horizontally co-planar with each other and having rotational axis orientated parallel to each other, wherein a tube of toothpaste may be removably positioned within said sleeve and between said cylinders such that toothpaste within the tube is extracted as said cylinders are selectively moved upwardly within said sleeve; and an actuator extending through said peripheral wall of said housing and being coupled to said cylinders, said actuator being adapted for selectively moving said cylinders upwardly or downwardly within said sleeve; and a cover being positioned on said upper edge of said housing for selectively closing said opening in said housing, a flange being integrally attached to and extending outwardly away from said cover, said cover having a dispensing conduit therein, said dispending conduit including a receiving opening extending upwardly into said cover, said dispensing conduit including an ejecting opening extending downwardly from said flange, wherein the tube may be fluidly coupled to said receiving opening when said cover is placed in a closed position such that toothpaste flows into said receiving opening and outwardly through said ejecting opening when the toothpaste is ejected out of the tube of toothpaste.

2. The assembly according to claim 1, wherein said peripheral edge has a plurality of wells extending therein, each of said wells being adapted for selectively receiving a toothbrush handle.

3. The assembly according to claim 1, wherein said actuator includes an elongated member having a first end extending outwardly away from said housing and a second end attached to said cylinders, a central portion of said elongated member being pivotally coupled to said housing.

4. The assembly according to claim 1, further including a latching assembly being mounted on said cover and being adapted for selectively locking said cover in said closed position.

5. The assembly according to claim 1, further including a mounting bracket being attached to said housing.

6. The assembly according to claim 1, further including a mounting bracket being attached to said housing, said mounting bracket being positioned generally opposite with respect to said actuator.

7. The assembly according to claim 2, wherein said actuator includes an elongated member having a first end extending outwardly away from said housing and a second end attached to said cylinders, a central portion of said elongated member being pivotally coupled to said housing.

8. A toothpaste dispensing assembly comprising:

a base having a top side, a bottom side and a peripheral edge, said top side having a rectangular shape such that said peripheral edge includes four side edges, a first of said side edge having a plurality of wells extending therein, each of said wells being adapted for selectively receiving a toothbrush handle;

a housing being attached to and extending upwardly from said base, said housing including a peripheral wall having an upper edge, said upper edge defining an opening extending into said housing, said peripheral wall including a first wall, a second wall, a third wall and a fourth wall;

a toothpaste tube squeezing assembly being mounted within said housing and being adapted for selectively ejecting toothpaste out of a tube of toothpaste, said squeezing assembly including;

a sleeve being fixedly mounted within said housing, said sleeve having an open upper end;

a pair of cylinders being mounted in sleeve and being selectively movable vertically in said sleeve, said cylinders being horizontally co-planar with each other and having rotational axis orientated parallel to each other, wherein the tube of toothpaste may be removably positioned within said sleeve and between said cylinders such that toothpaste within the tube is extracted as said cylinders are selectively moved upwardly within said sleeve;

an actuator extending through said peripheral wall of said housing and being coupled to said cylinders, said actuator being adapted for selectively moving said cylinders upwardly or downwardly within said sleeve, said actuator including an elongated member having a first end extending outwardly away from said housing and a second end attached to said cylinders, a central portion of said elongated member being pivotally coupled to said housing;

a cover being positioned on said upper edge of said housing for selectively closing said opening in said housing, a flange being integrally attached to and extending outwardly away from said cover, said cover having a dispensing conduit therein, said dispending conduit including a receiving opening extending upwardly into said cover and being generally aligned with said sleeve, said dispensing conduit including an ejecting opening extending downwardly from said flange, wherein the tube may be fluidly coupled to said receiving opening when said cover is placed in a closed position such that toothpaste flows into said receiving opening and outwardly through said ejecting opening when said cylinders are moved upwardly, a latching assembly being mounted on said cover and being adapted for selectively locking said cover in said closed position; and a mounting bracket being attached to said housing, said mounting bracket being positioned generally opposite with respect to said actuator.

* * * * *